US006682209B2

(12) United States Patent
Drake et al.

(10) Patent No.: US 6,682,209 B2
(45) Date of Patent: Jan. 27, 2004

(54) INTEGRAL WORKLIGHT

(75) Inventors: George Michael Drake, Stony Creek, NC (US); Raymond Joseph Hiller, Chapel Hill, NC (US); Kenneth Earl Ramsey, Greensboro, NC (US); Ross Alfred Horton, Graham, NC (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/997,902

(22) Filed: Nov. 30, 2001

(65) Prior Publication Data

US 2003/0103357 A1 Jun. 5, 2003

(51) Int. Cl.[7] ..... F21V 21/36

(52) U.S. Cl. ..... 362/403; 362/431; 362/387; 362/249; 362/376; 362/131; 362/132; 362/154

(58) Field of Search ..... 362/403, 431, 362/387, 249, 376, 131, 154, 132

(56) References Cited

U.S. PATENT DOCUMENTS 3,961,176 A * 6/1976 Gleason ..... 248/170
4,220,981 A * 9/1980 Koether ..... 362/238
5,418,701 A * 5/1995 Hart ..... 362/131
5,695,278 A * 12/1997 Grossman et al. ..... 362/374
5,699,943 A * 12/1997 Schaefer et al. ..... 16/335
6,164,803 A * 12/2000 Reniger et al. ..... 114/353

* cited by examiner

*Primary Examiner*—Sandra O'Shea
*Assistant Examiner*—Mark Tsidulko
(74) *Attorney, Agent, or Firm*—Thomas, Kayden, Horstemeyer & Risley LLP

(57) ABSTRACT

The present invention concerns a worklight that is easily and safety transportable. The worklight of the present invention includes a stand which defines an interior cavity. An extendable support or telescopic pole may be attached to the stand. The invention further includes at least one light fixture. The light fixture is sized to be stored within the cavity of the stand. The light fixture also includes a clamp. The clamp is adapted to releasably secure the fixture to the extendable support or telescopic pole. The stand further creates two points of contact with the support surface with the first point of contact being larger in size than the second point of contact.

10 Claims, 8 Drawing Sheets

INTEGRAL WORKLIGHT

BACKGROUND OF THE INVENTION

The present invention relates to portable worklights. More specifically, the present invention concerns a worklight that includes an integral stand that functions as a carrying case with telescopic pole to which light fixtures or other accessories may be releasably attached.

SUMMARY OF THE INVENTION

Traditional stand worklights are tripod in design, do not include an integral storage case and are typically transported from location to location in an unprotected manner. In most cases, the worklights are not easily removed from a cross bar attached to the stand. Thus, when transported, the worklights and stand bounce around during transportation and are usually scratched, or damaged in the process. A consumer, that may be concerned about protecting his investment, may purchase a separate storage case to use for worklight storage and transportation.

The present invention overcomes the above disadvantages, and others, by providing a storage case that houses light fixtures which are releasably attachable to a telescopic pole which extends from the storage case. This permits the storage case to further function as a stand for the light fixture or other releasably attachable accessories.

To further stabilize the device, a door of the device swings open into a locked position so that an additional leg may be extended for added stability. The case may also be divided into compartments for storing multiple objects. Lastly, the light fixtures, as well as other objects, are releasably attachable to the telescopic pole through the use of clamps having a plurality of jaw surfaces and multiple clamping positions. This allows the clamps to work with the different size diameter poles which form the telescopic pole.

DESCRIPTION OF THE DRAWINGS

These and other features, objects and advantages of the present invention will become apparent from the following description and drawings wherein like reference numerals represent like elements in several views, and in which.

Figure 3:
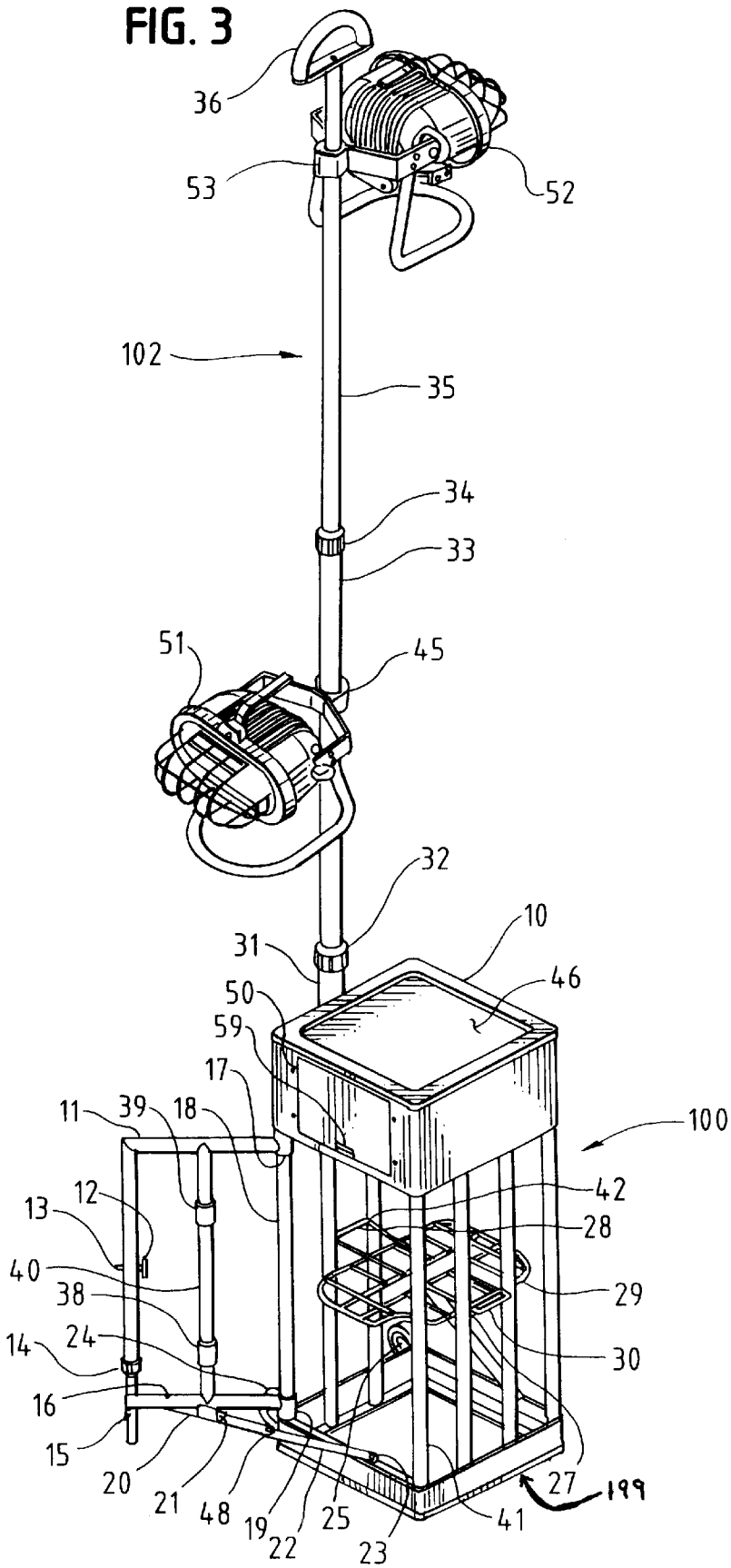
FIG. 3 is an isometric view showing the pole fully extended and light fixtures attached to the pole.
Figure 4:
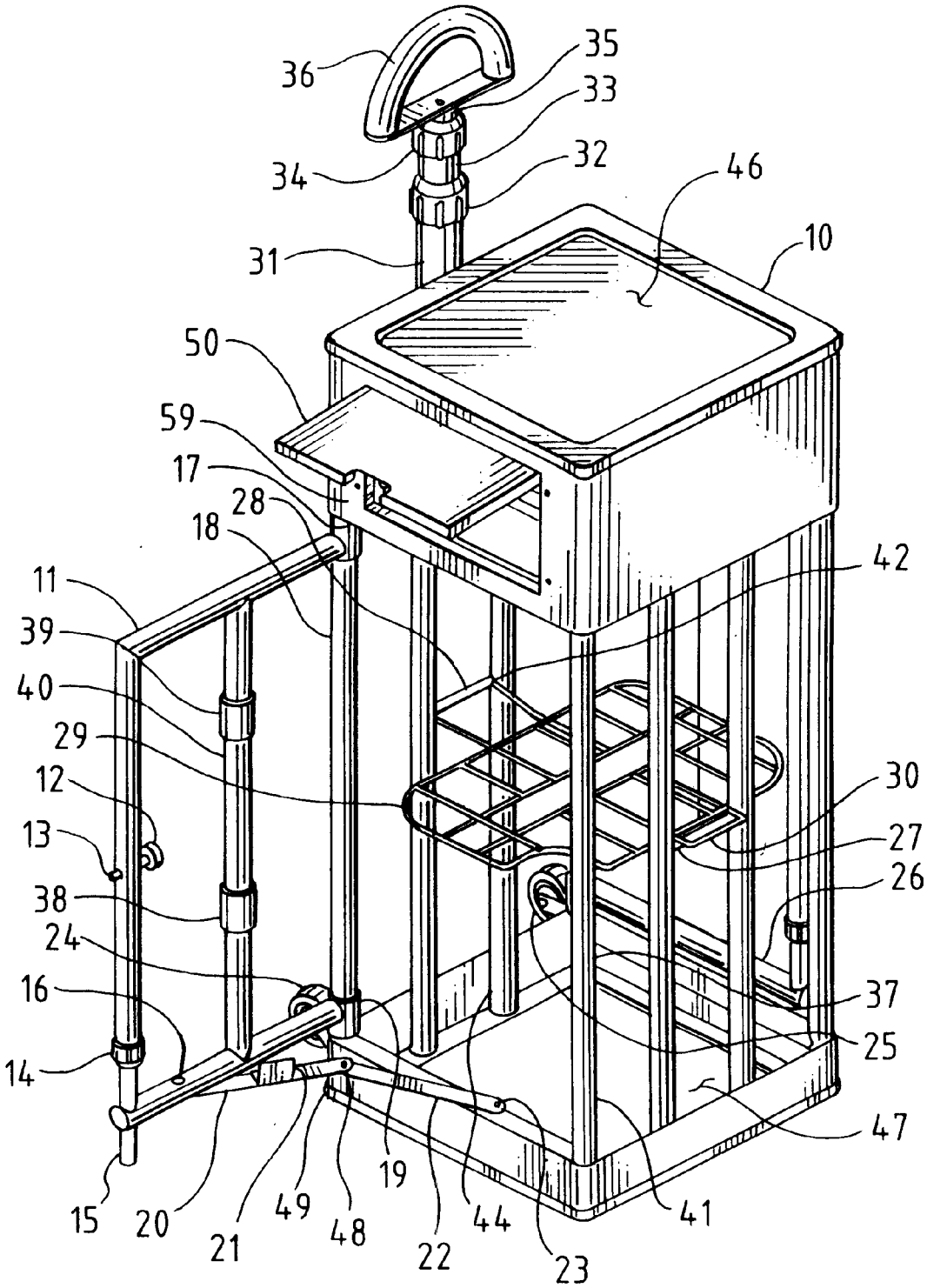
FIG. 4 is an isometric view of the stand or case with one door opened 90° and the worklights removed.

The poles used to construct the device may either be of a one-piece construction or made up of individual segments connected by connectors 38 and 39 as shown in FIGS. 3 and 4.

DESCRIPTION OF THE PREFFERED EMBODIMENTS

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

The reference is now made primarily to all of the figures shown, where worklight 100 is shown having a stand or case 10, and light fixtures 51 and 52. Each fixture may include a multi-position fixture lock or clamp 45 and 53 and fixed handles 81 and 82 for angular adjustment of the heads 91 and 93. However, it is contemplated that other lighting fixture designs could be used with the present invention as well as accessories such as fans, junction boxes, clamps and the like. FIG. 3 shows lighting fixtures 51 and 52 clamped directly to an expandable or extendable support such as a vertical pole 102. It is anticipated that other mounting means known to those of skill in the art may also be used to attach the light fixtures and any other accessories or objects to the pole.

Stand or case 10 is shown as a rectangular box constructed of a sheet metal top and bottom with tubular poles supporting each end and doors constructed of tubular poles. However, other materials or fabrication techniques may be used to construct stand 10. Vertical pole 102 is shown as being telescopic with three sections 31, 33 and 35. Beginning with section 31, each section is progressively smaller in diameter. While three sections are shown, any number of sections may be used. In addition, the extendable or expandable support 102 may be comprised of section that are hinged together and in other ways known to those of skill in the art which would result in the capability of the support to increase in size or length.

Figure 1:
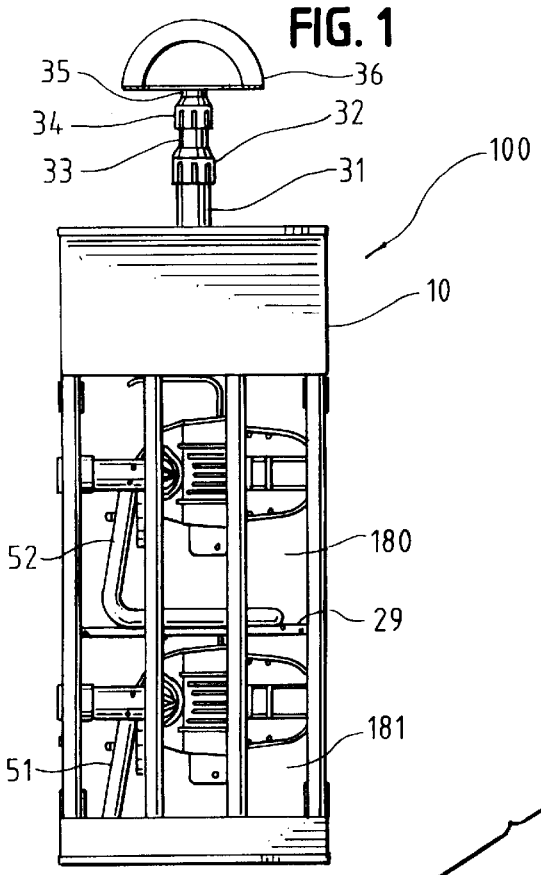
FIG. 1 is a front view of the stand or case with light fixtures stored within.
Figure 2:
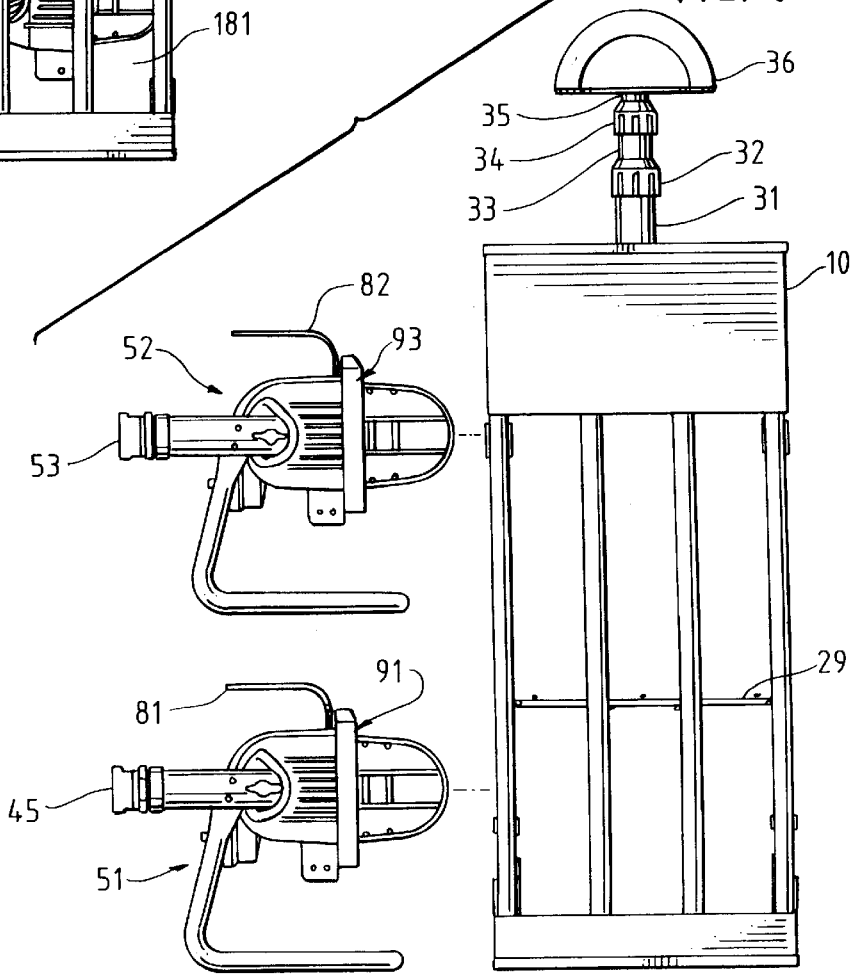
FIG. 2 is a front view showing the removal of the fixtures from the case and a collapsed vertical pole.

Stand or case 10 is shown with a wire shelf 29 that is fixed on one end which defines storage compartments 180 and 181 as shown in FIG. 1. Shelf 29 may be rotated upwardly into upper compartment 180 to allow easy access to the lower compartment 181. As with stand 10, wire shelf 29 could be constructed from other materials and could be in a fixed position, or not used at all, if desired.

Figure 8:
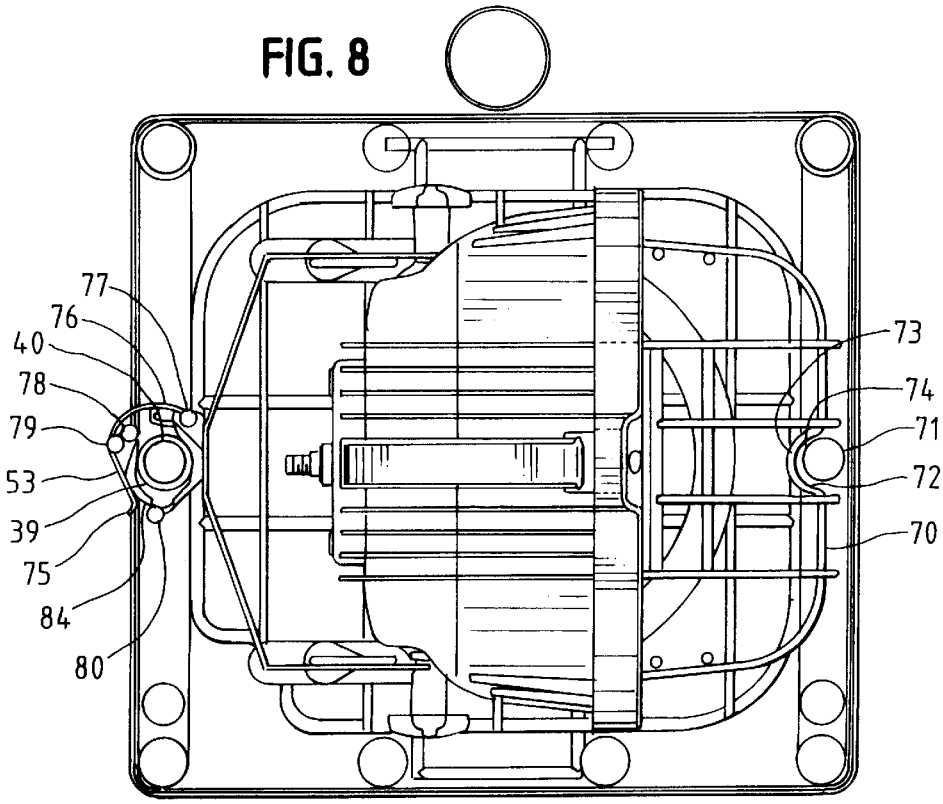
FIG. 8 is a top cross sectional view showing the lighting fixture in a stored position.

In a preferred embodiment, lighting fixtures 51 and 52 may be removed from stand or case 10, by unlatching locks or clamps 45 and 53 from pole 40 of door 11. As illustrated in FIG. 8 and described in more detail below, this can be accomplished by pulling on lever 75 which causes lever 75 to rotate about pivot point 78 which causes pivot point 79 to rotate about pivot point 78 in a clockwise motion relieving pressure on spring 76 until a hook located on the end of spring 76 is disengaged from pin 77. Spring 76 is rotated in a counterclockwise motion about pivot point 80 until fully clear of tube 40 on door 11.

To open door 11, as shown in FIG. 4, latch knob 12 is pulled inwardly toward pole 40 on door 11 until latch pin 13 clears hole 37 in vertical pole 41. Of course, latch 12 may be configured to operate in different directions as well.

Door 11 is positional through the use of pivot tubes 17 and 19 which rotate about pole 18 in a clockwise direction until the knee action locking bars 20 and 22 lock into position with door 11 open approximately 135 degrees. Once the door has been opened, stabilizer leg 15 may be lowered down to stabilize and level stand or case 10. To accomplish this, knob 14 is rotated to loosen the lock which allows pole 15 to be positioned until the desired length has been achieved. Knob 14 is rotated in the opposite direction to secure leg 15 in the desired position. The fixtures or accessories may then be slid out through the opening created when door 11 is in an open position.

In an alternate embodiment, the present invention includes multiple doors as described above for additional ease of use. Moreover, additional stabilizers may be used with each door or provided separately for further support by creating additional points of contact with a support surface other than the larger surface area point of contact created by the base 199 of the stand 10 and smaller surface area point of contact created by stabilizer 15.

Figure 7:
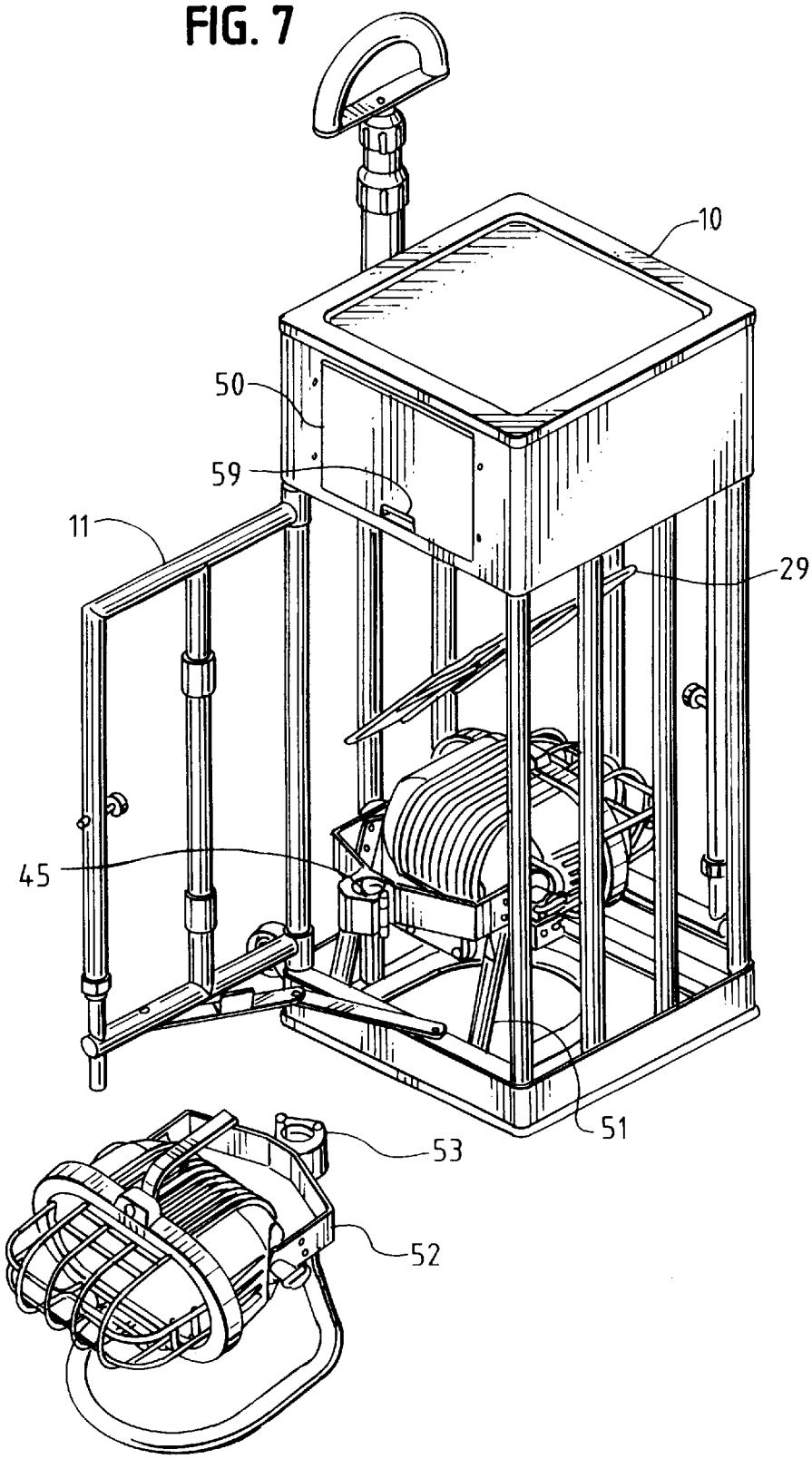
FIG. 7 is an isometric view showing the stand or case with its door opened 90° with the wire rack rotated up to allow a second worklight to be removed from storage.

As shown in FIGS. 4 and 7, wire rack 29 is positionable by using handle 30 and lifting wire rack rod 28 to pivot about hole 42 in pole 44 in a counterclockwise direction until enough space is provided to remove the lower lighting fixture from the stand or case. This is illustrated in FIG. 7. Wire rack 29 may then be rotated back in a clockwise direction to the at rest position with end 30 resting on bar 27. This is illustrated in FIG. 4.

Pole 33 is extended by rotating locking collar 32 in a counterclockwise direction to loosen the locking collar which permits the positioning of pole 33. Locking collar is rotated in a clockwise direction to secure pole 33 in a desired position. Pole 35 is extended by rotating locking collar 34 in a counterclockwise direction to loosen the locking collar to permit the positioning of pole 35. Locking collar 34 is rotated in a clockwise direction to secure pole 35 in position. A handle 36 is also provided for ease of use.

The lighting fixtures may be attached at any height on either pole 33, or pole 35 using fixture clamps 45 and 53. The method of using clamps 45 and 53 is explained in further detail below.

Figure 5:
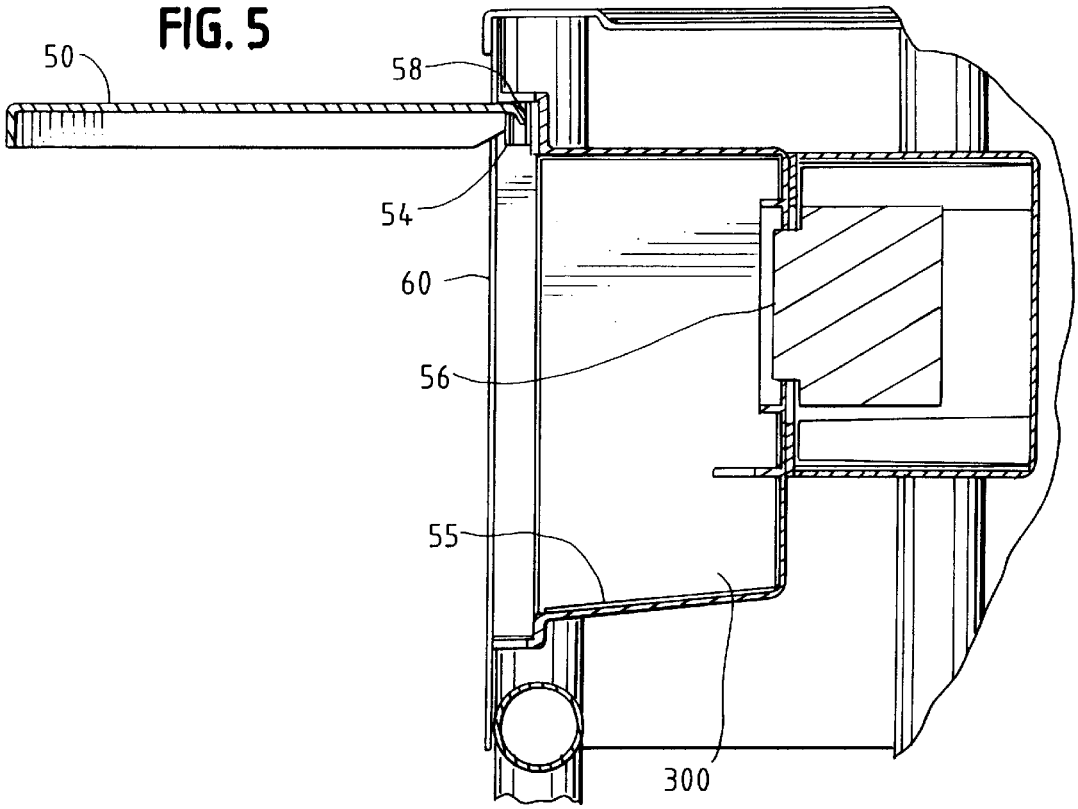
FIG. 5 is a cross sectional view of the electrical power box that is integrated into the stand or case shown with its door open 90°.
Figure 6:
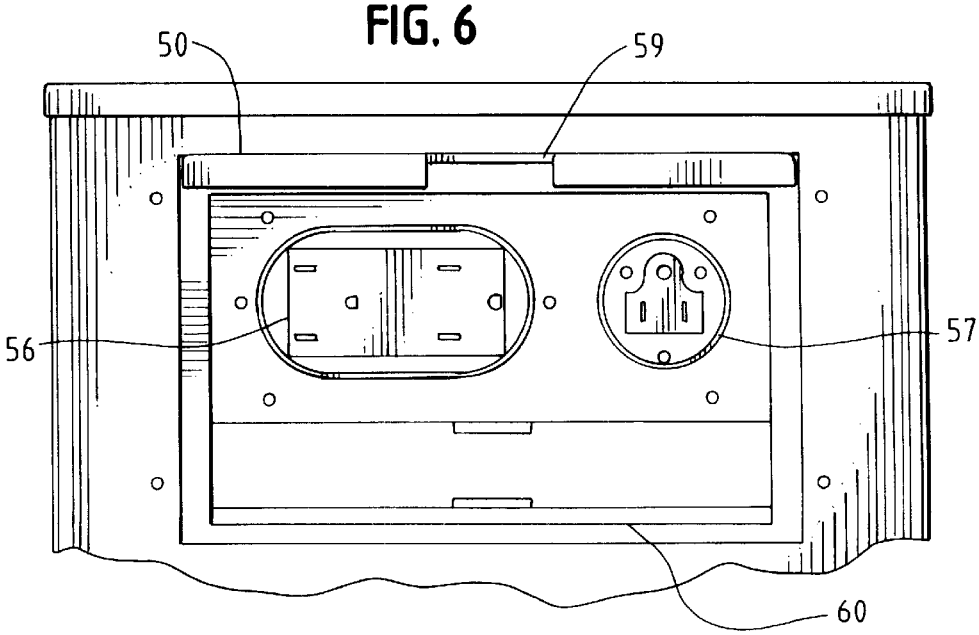
FIG. 6 is a partial side view of the stand or case showing the electrical power box with its door opened 90°.

As shown in FIGS. 5 and 6, stand or case 10 may further include an integrated GFCI (ground fault circuit interrupter) receptacle 56 located behind door 50 along with an extension cord receptacle 57 to provide electrical power to the lighting fixtures 51 and 52 and accessories, if needed. When door 50 is opened, feature 58 of door 50 will depress spring 54 causing it to exert force on feature 58 which causes door 50 to automatically close after a user has released hold on the door. The interior floor 55 of GFCI box 60 is also inclined to prevent water from accumulating inside cavity 300 and an opening 59 is provided for the power cord exit as shown in FIGS. 3 and 4. The power cord exit hole 59 in door 50 will allow water to drain from the interior 300 of GFCI box 60 in the event that water gets in through power cord exit hole 59. It may also permit cords to exit compartment 300 when the receptacles are in use.

Recessed area 46 on top of stand or case 10 may be used to place parts while working on a project. Recessed area 46 prevents parts from rolling off during use.

Lighting fixtures 51 and 52 are releasably attachable to the poles and after use are placed inside of case 10 for safe storage and transportation. To do this and as shown in FIGS. 4 and 7, wire rack 29 is rotated counterclockwise about hole 42 until enough space is provided to allow a lighting fixture to pass between knee action locking bar 22 and bottom of wire rack 29. This permits the fixture to be placed inside the stand on bottom end panel 47. As shown in FIG. 8, tube 71 of stand or case 10 is positioned to capture feature or indentation 72 of wire grill guard 70. Tube 71 seats within the indentation so that point 73 and point 74 are in contact. This nesting arrangement assists in securing the light fixture within case 10.

To safely store the next fixture, wire rack 29 may be rotated in a clockwise direction causing pivot bar 28 to pivot about hole 42 in bar 44 until wire rack end 30 comes to rest on bar 27. The second fixture may then be removed from the pole and slid into stand or case 10 on top of wire rack 29. Again, tube 71 of stand or case 10 is positioned to capture feature or indentation 72 of wire grill guard 70 and seated, so that point 73 and point 74 are in contact. Again, this nesting arrangement releasably secures the light fixture inside the case 10 to assist in safe storage and transportation.

Prior to closing door 11, clamps 45 and 53 need to be fully opened. Next, stabilizing leg 15 is raised by rotating locking collar 14 to loosen leg 15 which allows leg 15 to be retracted until it stops. Locking collar 14 is then retightened to lock stabilizing leg 15 in the up position. Door 11 is closed by pushing inwardly at point 48 on knee action locking bar 20 until door 11 begins to rotate counterclockwise. The rotation of door 11 in a counterclockwise direction causes pivot tubes 17 and 19 to rotate about tube 18 until door 11 is almost closed. Pull knob 12 is again retracted towards tube 40, while door 11 is rotated into a closed position until locking rod 13 is positioned in alignment with hole 37 in tube 41. Knob 12 is then released which locks door 11. Stop bracket 21 prevents door 11 from over rotating past hole 37 in tube 41 and keeps knee locking bars 20 and 22 from extending beyond door 11 when door 11 is closed. Clamps 45 and 53 may then be locked onto tube 40 of door 11. This further assists in safely securing the light fixtures within cage 10 and prevents damage during transportation due to the unwanted movement of the stored objects.

Collapsible pole may then be lowered to aid in the transportation of worklight 100. Pole 33 is lowered by rotating locking collar 32 in a counterclockwise direction to loosen the locking collar and to allow pole 33 to collapse into pole 31. Pole 33 is locked in place by rotating locking collar 32 in a clockwise direction. Pole 35 is lowered by rotating locking collar 34 in a counterclockwise direction to loosen the locking collar and to allow pole 35 to collapse into pole 33. Pole 35 is locked in place by rotating locking collar 34 in a clockwise direction.

In another embodiment of the present invention, stand or case 10 may include wheels 24 and 25 which are positioned to be raised so as not to engage a rolling surface when the case is resting on a support surface during use. Wheels 24 and 25 engage a surface when the stand is tilted. This allows stand or case 10 to be easily transported by being pulled along by handle 36 while stand or case 10 travels on wheels 24 and 25.

Figure 9:
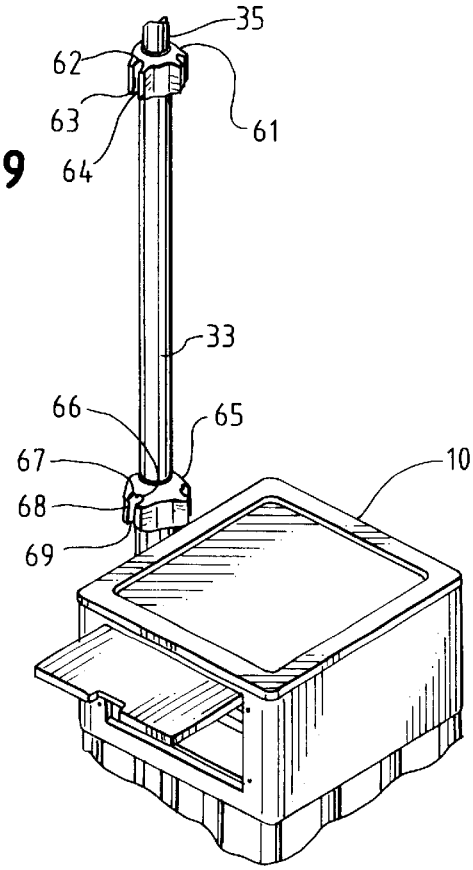
FIG. 9 is an isometric view of an additional embodiment for the vertical pole locking collars.
Figure 10:
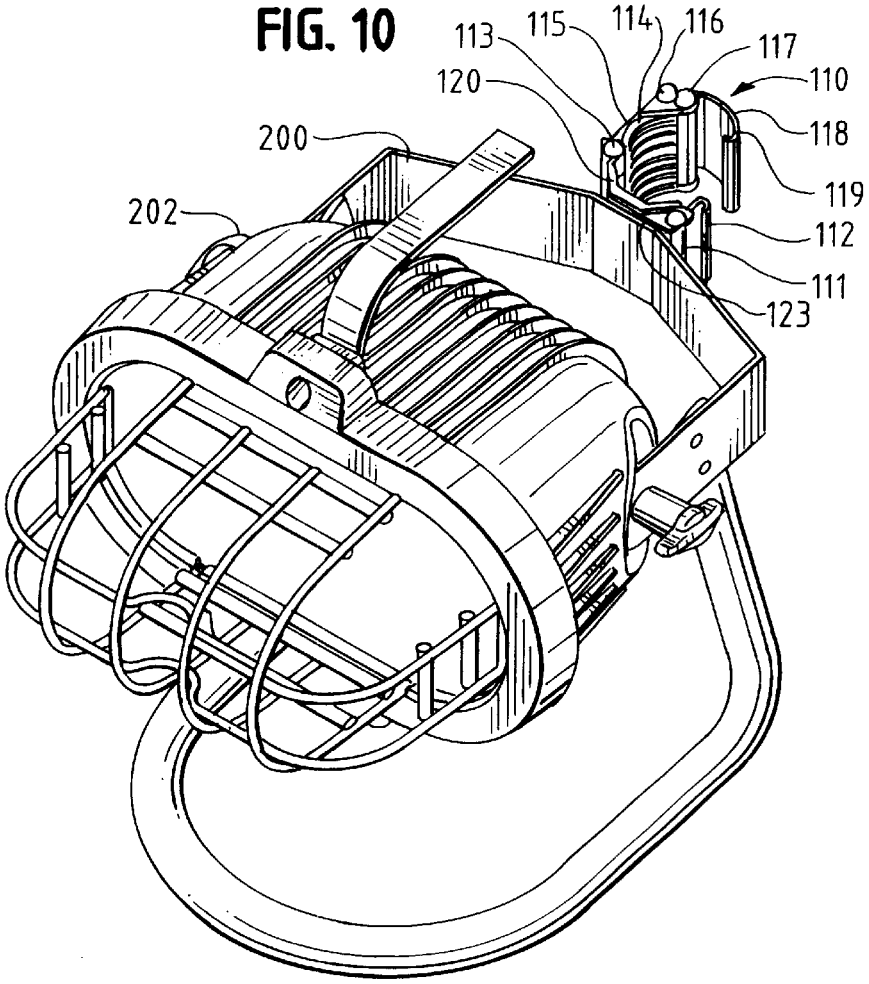
FIG. 10 is a perspective view of a clamp in an unlatched or open position which has been affixed to a light fixture.

FIG. 9 shows an alternate embodiment of locking collars 61 and 65 which incorporate power cord restraining features. After light fixtures or corded accessories are releasably attached to the poles, a user may snap a power cord (not shown) that is protruding from the back of the object into slot 62. This releasably traps the power cord inside of slot 62 and between retaining features 63 and 64. After power cord is restrained, the power cord may then be plugged into the electrical power receptacle (GFCI) 56. This may be repeated with other objects attached to the poles through the use of additional slots such as 67 and additional retaining members 68 and 69.

The details of the clamps are now discussed with reference made primarily to FIGS. 10–14. While the clamp of the present invention is described as working in connection with round tubing, the locking assembly or clamp 110 may be used with other support shapes as well. Other configurations for the fixture and accessory support include, but are not limited to, designs that are square, triangular, oblong, T-shaped, and I-beam-like in configuration.

Views are only shown with two positions, but it is anticipated that any number of positions could be created. While this particular embodiment of the present invention is shown attached to a flat bar bracket 200 on fixture 202, it may also be attached to any part of the lighting fixture, or accessory.

A pad 120 and 124 are shown in FIGS. 10–14 as forming part of the moveable jaw 144 and stationary jaw 192. However, clamp 110 could be produced with only one pad, or possibly no pads at all.

Lock assembly or clamp 110 is comprised of a base 123 which includes a pivot point 113 formed by a receptacle which receives a pin 113 on one side and receptacles which hold lock hook retention pins 111 and 112 on the other side of the base. Clamping member or moveable jaw 114 is attached to base 123 by pivot point 113 on one end and attached to handle 115 on the other end by pivot point 117.

As shown in FIGS. 11–14, this embodiment of the present invention includes body 190 from which handle 115 extends. Body 190 includes two receptacles which also house pins to form spaced apart pivot points 116 and 117.

Lock member 118 extends from body 190 and is attached to handle 115 by pivot point 116 and is formed with a hook 119 on the other end to be hooked onto hook retention pins or retainers 111 or 112.

When attaching lock assembly or clamp 110 to smaller pole cross section 121, lock hook 119 engages retention pin 111 to create a first moveable jaw configuration. Handle 115 may be swung around causing axis of pivot point 116 to go over center in relationship to the axis of pivot point 117. This causes handle 115 to snap into a closed position on clamping member 114 resulting in the moveable jaw 114 and stationary jaw 192 of base 123 being biased towards one another around the pole.

Figure 12:
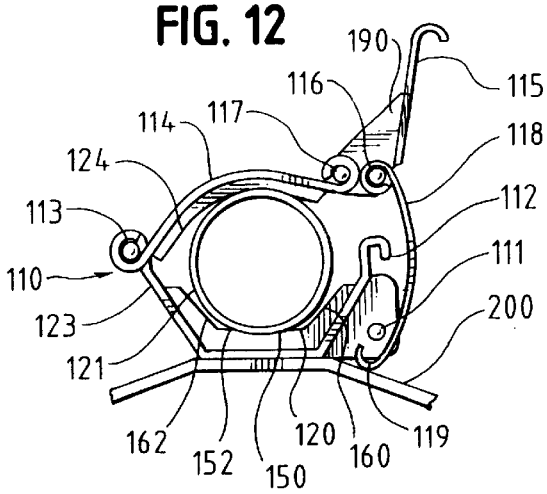
FIG. 12 is a cross section showing a clamp in a ready position for latching around a smaller cross section pole.
Figure 13:
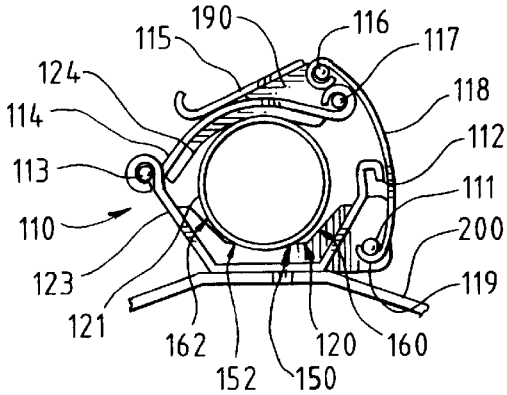
FIG. 13 is a cross section showing a clamp in a locked position around a smaller cross section pole.

A pad 120 may also be provided which allows for variations in tolerances of all parts in the assembly and creates needed friction for locking to an object such as a pole. This is accomplished by forming pad 120 in such a manner to include two sets of jaw surfaces. The first set is comprised of surfaces 150 and 152. As shown in FIGS. 12 and 13, lock assembly is secured to pole 121 by the clamping action generated by the assembly and the contact of pad 124 and surfaces 150 and 152 of pad 120 with the object to be secured.

Figure 11:
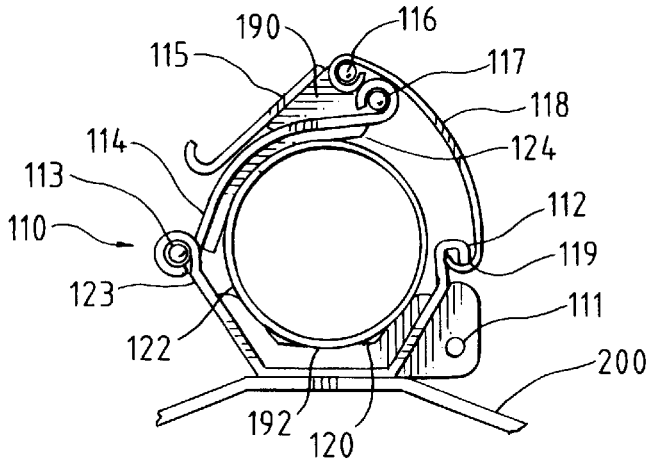
FIG. 11 is a cross section showing a clamp in a locked position around a larger cross section pole.
Figure 14:
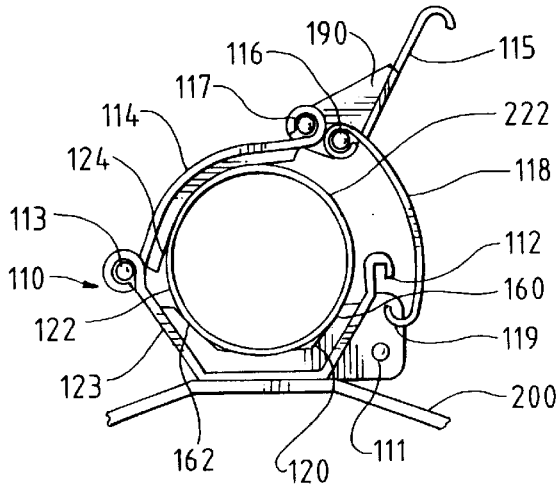
FIG. 14 is a cross section showing a clamp in a ready position for latching around a larger cross section pole.

When attaching lock assembly 110 to the larger pole cross section 122, lock hook 119 engages retention pin or retainer 112 to create a second jaw configuration which is larger than the first configuration, in that, the distance between jaws 114 and 192 is greater. Lock handle 115 is then swung around causing axis of pivot point 116 to go over center in relationship to axis of pivot point 117. This causes lock handle 115 to snap into a closed position which biases the jaws towards one another to secure clamp 110 onto the pole. This is further assisted by the second set of jaw surfaces 160 and 162 on pad 124. As shown in FIGS. 11 and 14, surfaces 160 and 162 assist in retaining the clamp on larger diameter pole 122 by producing additional points of contact. Of course, other spatially different jaw sizes may be created by using additional pins other than 111 and 112. In addition, the clamp may include other jaw surfaces to provide even more points of contact with the object to be retained. As shown in FIGS. 11 and 14, when accommodating larger sized objects, the second set of jaw surfaces 160 and 162 also engage the object. This assists in securing the fixture to the support or pole 122.

Although reference has been made to pivot points constructed from receptacles and pins and lock retention pins, it is contemplated that the present invention may be constructed with any suitable means of attaching pivoting and locking members. Configuring the worklight to use a pole or some other similar support in conjunction with a locking assembly allows a consumer the ability to attach a plurality of worklights, or accessories on one worklight stand and easily remove or reposition the fixture, or accessories on the same, or different diameter sections of the telescoping pole of the stand, as needed. A user does not have to adjust telescoping sections of stand pole to raise and lower height of light source and has the ability to positively lock, but not permanently lock the lighting fixture at different elevations on a vertical pole of the stand, as well as at different angles to centerline. The ability to mount fixture at different angles provides the consumer a possible 360° of light coverage, or the ability to illuminate a complete wall either horizontally or vertically.

While the preferred embodiments of the present invention have been illustrated and described, it will be understood by those of ordinary skill in the art that changes and other modifications can be made without departing from the invention in its broader aspects. Various features of the present invention are set forth in the following claims.

What is claimed is:

1. A worklight for use on a support surface comprising:

a stand defining an interior cavity and capable of forming a first point of contact with the support surface;

an extendable support affixed to said stand;

at least one light fixture, said light fixture sized to be stored within said cavity of said stand;

said fixture including a clamp, said clamp adapted to releasably secure said fixture to said support;

a door located on said stand which is operable between a closed and open position, in said open position said door is capable of forming a second point of contact with the support surface; and said first point of contact is larger in size than said second point of contact.

2. The worklight of claim 1 wherein said door includes an extendable leg, said leg adjustable in length.

3. A worklight for use on a support surface comprising:

a stand defining an interior cavity and capable of forming a first point of contact with the support surface;

an extendable support affixed to said stand;

at least one light fixture, said light fixture sized to be stored within said cavity of said stand;

said fixture including a clamp, said clamp adapted to releasably secure said fixture to said support;

a plurality of doors located on said stand with at least one of said doors capable of forming a second point of contact with the support surface; and said first point of contact is larger in size than said second point of contact.

4. The worklight of claim 3 wherein each door includes an extendable leg, said leg adjustable in length.

5. A worklight for use on a support surface comprising:

a stand defining an interior cavity and capable of forming a point of contact with the support surface;

an extendable support affixed to said stand;

at least one light fixture, said light fixture sized to be stored within said cavity of said stand;

said fixture including a clamp, said clamp adapted to releasably secure said fixture to said support; and said light fixture nests within said stand through the use of an indentation on said fixture and said clamp.

6. A worklight for use on a support surface comprising:

a stand defining an interior cavity and capable of forming a point of contact with the support surface;

an extendable support affixed to said stand;

at least one light fixture, said light fixture sized to be stored within said cavity of said stand;

said fixture including a clamp, said clamp adapted to releasably secure said fixture to said support;

said clamp is comprised of a first jaw surface pivotally connected to a second jaw surface; and said clamp operable between open and closed positions.

7. The worklight of claim 6 wherein said clamp is configurable into at least first and second jaw configurations, in said first jaw configuration, said jaw surfaces are positioned closer together than when said clamp is configured in said second jaw configuration.

8. A worklight for use on a support surface comprising:

a stand defining an interior cavity;

an extendable support affixed to said stand;

at least one light fixture, said light fixture sized to be stored within said cavity of said stand;

said fixture including a clamp, said clamp adapted to releasably secure said fixture to said support; and said stand capable of forming a point of contact with the support surface and said stand is comprised of a top side, a bottom side and four opposing side walls.

9. The worklight of claim 8 wherein said side walls are comprised of tubes.

10. The worklight of claim 8 wherein said top surface includes a shelf.

* * * * *